US010092119B2

(12) United States Patent
Cramer

(10) Patent No.: US 10,092,119 B2
(45) Date of Patent: Oct. 9, 2018

(54) SEA SALT CUP WITH AN INNER LINING

(71) Applicant: Allen B. Cramer, Fort Lauderdale, FL (US)

(72) Inventor: Allen B. Cramer, Fort Lauderdale, FL (US)

( * ) Notice: Subject to any disclaimer, the term of this patent is extended or adjusted under 35 U.S.C. 154(b) by 0 days.

(21) Appl. No.: 14/687,545

(22) Filed: Apr. 15, 2015

(65) Prior Publication Data

US 2016/0304246 A1 Oct. 20, 2016

(51) Int. Cl.
*B65D 19/00* (2006.01)
*A47G 19/22* (2006.01)

(52) U.S. Cl.
CPC ..... *A47G 19/2205* (2013.01); *A47G 2400/04* (2013.01); *A47G 2400/105* (2013.01)

(58) Field of Classification Search
CPC ..... A47G 19/2205; A47G 21/004; A47G 2400/04; A47G 2400/105; B65D 11/16; B65D 13/00; B65D 25/14
USPC ..... 220/23.87, 62.12, 62.22
See application file for complete search history.

(56) References Cited

U.S. PATENT DOCUMENTS 1,509,194 A * 9/1924 Dresser ..... A23G 3/343 426/138
1,528,873 A 3/1925 Curtin
1,574,259 A 2/1926 Sarff
3,810,557 A * 5/1974 Cline ..... A47G 19/2288 215/12.1
4,299,100 A * 11/1981 Crisman ..... B65D 81/3883 220/592.17
4,457,103 A 7/1984 Aloziem
4,625,518 A * 12/1986 Freedman ..... A47G 19/2288 62/1
5,076,463 A * 12/1991 McGraw ..... A47G 19/2288 126/400
5,622,739 A * 4/1997 Benton ..... A23K 40/20 426/103
5,752,653 A * 5/1998 Razzaghi ..... A47G 23/0216 206/515
7,124,603 B2 10/2006 Bianco
8,770,429 B2 7/2014 Stern
2010/0078440 A1* 4/2010 Bargan ..... F24J 1/00 220/592.2
2010/0276420 A1 11/2010 McKee
2013/0213960 A1* 8/2013 Cook ..... A47G 19/2205 220/23.87
2014/0183198 A1 7/2014 Slack

* cited by examiner

*Primary Examiner* — J. Gregory Pickett
*Assistant Examiner* — Niki M Eloshway
(74) *Attorney, Agent, or Firm* — Calrie Marsh, Esq.

(57) ABSTRACT

A sea salt cup, made from a single block of unrefined sea salt, having an inner lining to significantly minimize or prevent the intermixing of the salt with any liquid or food item contained therein, and also having a salty lip for enhancing the flavor of the liquid or food item contained therein. The sea salt cup comprises a uniform exterior portion, a uniform hollow interior receptacle, a flat bottom, a flat rim, and an inner lining. The inner lining is made of plastic or other durable material and serves as a barrier between the salt and any liquid or food item contained in the sea salt cup.

6 Claims, 6 Drawing Sheets

SEA SALT CUP WITH AN INNER LINING

STATEMENT REGARDING FEDERALLY SPONSORED RESEARCH OR DEVELOPMENT

This invention has been created without the sponsorship or funding of any federally sponsored research or development program.

FIELD OF INVENTION

The present invention relates to a sea salt cup, made entirely of unrefined sea salt, having an inner lining to prevent or minimize the intermixing of the salt with any liquid or food contained therein while enhancing the flavor of its contents.

BACKGROUND

Prior art in this area is focused on a sea salt shot glass which imitates the traditional shot glass that is common place in bars, restaurants, and souvenir shops worldwide and is usually made from glass or like material and used for the consumption of alcoholic beverages. Shot glasses vary in sizes, shapes, and decorative patterns, but the one universal constant is that they are comprised mainly of glass or similar solid stable and transparent materials. In the field of this invention, there are shot glasses made of metals such as copper, plastics, ice or other materials including salt. However, this invention is not limited to being a receptacle for merely alcoholic beverage, but encompasses the gamut of food items and/or items suitable for consumption.

It is well known that salt is used as a flavoring agent for food as well as drinks, including alcoholic beverages such as tequila, margaritas, bloody mary, vodka, beer, or even bourbon. Although salt is used to enhance the taste of these beverages, it may also serve as a decorative feature of a shot glass or drink glass (e.g. around the rim of a margarita glass). Generally, the salt used in bars and restaurants is iodized salt or refined table salt. However, there has been a trend towards using unrefined salt, namely sea salt, which adds a richer flavor to food and beverages. The origin of unrefined or natural sea salt plays a role in its richness and flavor. Natural sea salt has its trace minerals left intact giving a richer, more complex flavor than table salt and there are no additives. The texture of natural sea salt varies from region to region, harvester to harvester and is surprisingly different around the world. It can be a thin crisp flake, a coarse chunk, or a tiny pearl. The color can be white or grey or pink. Some salt is completely dry while some is left moist. There are many styles of natural sea salt to choose from which opens up a world of experimentation.

There has been experimentation with the salt shot glass, comprised completely from salt and allows for the pouring of liquid into a salt lined receptacle. However, these variations on the salt shot glass require immediate consumption of any liquid poured into it due to the rapid erosion of the salt, the mixing of the salt and liquid in proportions which corrupts the flavor of the liquid, and if left for too long the leaking of liquid from the salt shot glass. In order to maintain the integrity and stability of the salt shot glass, the origin and composition of the salt must be such that it is resistant to erosion at room or normal indoor temperatures, as well as being hard enough to withstand breaking and crumbling when packaged and shipped. In addition, these sea salt shot glasses are not suitable for the consumption of solid or semi-solid food items such as chilled soups or stews or ceviche style dishes. A more suitable design is for a cup or similar receptacle made entirely of salt which overcomes the limitations of the traditional shot glass.

SUMMARY OF THE INVENTION

The present invention serves to improve upon existing salt shot glasses and address the above mentioned problems.

The present invention is a salt cup or receptacle made from unrefined sea salt mined in the mountains of Pakistan and carved from a single block of sea salt. This feature addresses the issue of the stability of the sea salt shot glass and its resistance to crumbling and rapid erosion under normal temperature and shipping conditions. In the preferred embodiment of the invention, the interior of the sea salt cup has an inner lining which serves as a barrier between the liquid, solid or semi-solid food item and the hollow interior of the sea salt cup, without diminishing the flavoring of the liquid, solid, or semi solid food item. The preferred embodiment of this invention comprises the combination of the sea salt cup or receptacle; and the inner lining made of plastic or other durable material not susceptible to erosion by food items, including alcoholic beverages. The inner lining prevents or significantly minimizes the mixing of the food item with the salt, effectively preserving the enhanced flavor of the food item when sipped or tasted. The inner lining is fashioned to meet the size and dimensions of the salt cup for easy, snug, and seamless insertion and fit. The inner lining of the sea salt cup has a lip or slight overhanging lip and is fashioned to fit flush against the hollow interior of the sea salt cup. There is a 0.5 mm or greater distance between the rim of the sea salt cup and the inner lining, essentially creating a salty lip. This portion of the sea salt cup comes in contact with the lips of the user and provides an added salty flavor to the contents of the salt cup. Upon sipping or tasting the liquid or food inside the sea salt cup, the drinker's mouth first comes into contact with the salty lip of the sea salt cup followed immediately by the liquid or other food item, and thus he is able to experience the flavor of the salt mixed with the liquid or other food item.

In another embodiment of the present invention, the inner lining of the sea salt cup may be removable, providing a user with the option to insert or remove the inner lining depending on the desired level of salty flavoring. For example, a user who is taking a shot of alcohol may opt to remove the inner lining. Whereas another user may choose not to remove the inner lining in order to enjoy lesser salty flavor with a chilled soup, such as gazpacho. In this embodiment of the invention, the salty lip is retained and may serve as the maximum point for filling liquid or other food time, as well as the source of salty flavor before, during and/or after consuming a particular food item

BRIEF DESCRIPTION OF THE DRAWINGS

The accompanying drawings incorporated in and forming a part of the specification, illustrate several aspects of the present invention, and together with the description serve to explain the principles of the invention. In describing the invention, reference will at times be made to the accompanying drawings in which.

DESCRIPTION OF THE INVENTION

Before the subject invention is described further, it is to be understood that the invention is not limited to the particular embodiments of the invention described below, as variations of the particular embodiments may be made and still fall within the scope of the invention. It is also to be understood that the terminology employed is for the purpose of describing particular embodiments, and is not intended to be limiting.

The details of one or more embodiments of the invention are set forth in the accompanying drawings and the description below. Other features, objects, and advantages of the invention will be apparent from the description and drawings, and from the claims. In the following description, numerous specific details are set forth to provide a thorough understanding of the embodiments. One skilled in the art to which this invention belongs will recognize, however, that the techniques described can be practiced without one or more of the specific details, or with other methods, components, materials, etc. In other instances, well known structures, materials or operations are not shown or described in detail to avoid obscuring certain aspects.

In this specification, the singular forms "a," "an" and "the" include plural reference unless the context clearly dictates otherwise. Unless defined otherwise, all technical and scientific terms used herein have the same meaning as commonly understood to one of ordinary skill in the art to which this invention belongs.

Figure 1A:
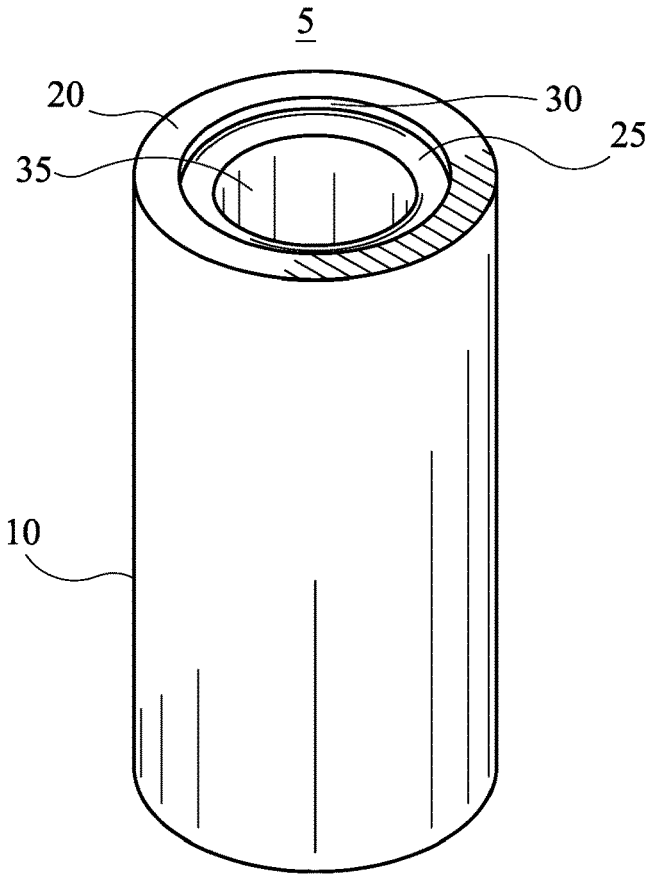
FIG. 1A is a perspective view of the present invention with the inner lining.
Figure 1B:
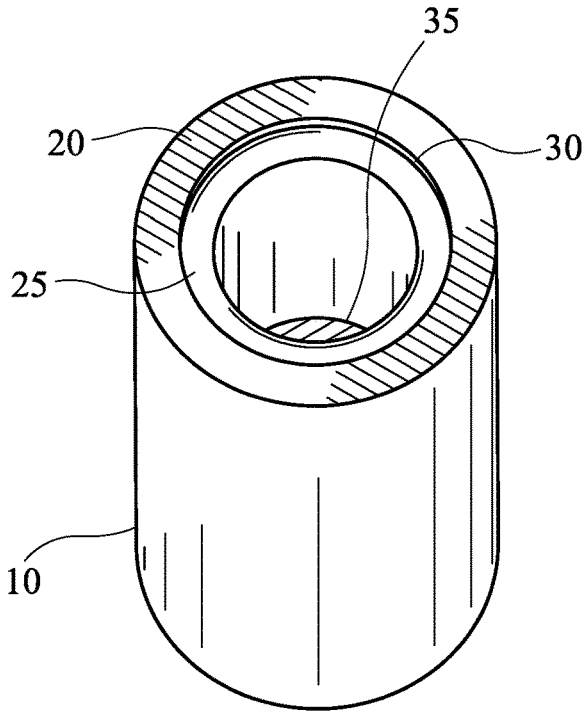
FIG. 1B is a top perspective view of the present invention with the inner lining.

FIG. 1A is a perspective view of the present invention; a sea salt cup 5 formed from a single block of unrefined sea salt, comprising an outer sea salt portion 10, an inner lining 35 for holding various food items, and a salty lip 30. The inner lining has a lip 25 which is positioned flushed against the hollow salt interior 15 of the sea salt cup (see FIG. 2A). The salty lip 30 as represented in FIG. 1A begins at the rim 20 of the sea salt cup 5 extending about 0.5 mm into the hollow interior portion 15 of the sea salt cup, and ending at the lip 25 of the inner lining 35. Although FIG. 1A illustrates the salty lip 30 with a height of 0.5 mm, this is not intended to be limiting as the height of the salty lip 30 may vary in proportion to the size, dimension, and shape of the sea salt cup 5. FIG. 1B is top perspective view of the invention, showing the rim of the sea salt cup 20, the salty lip 30, the inner lining 35, and the lip of the inner lining 25.

Figure 2A:
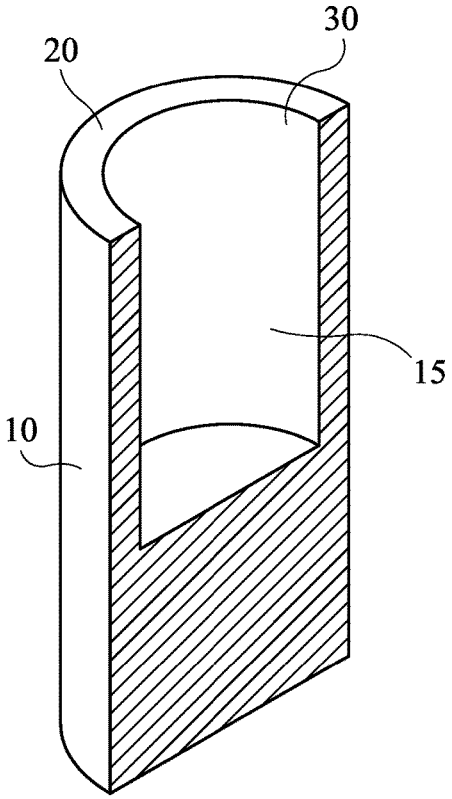
FIG. 2A is a cross sectional view of the present invention without the inner lining.
Figure 2B:
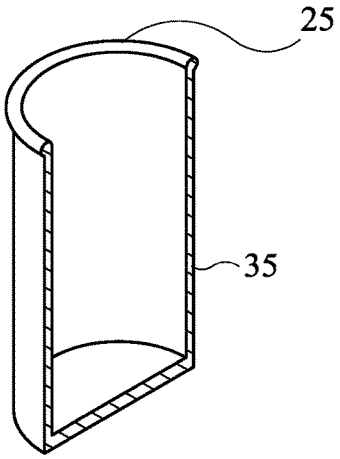
FIG. 2B is a cross sectional view of the inner lining of the present invention.
Figure 2C:
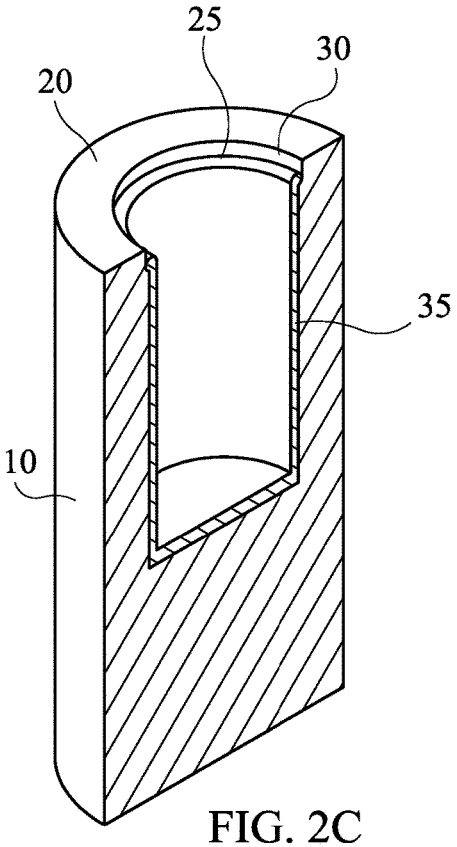
FIG. 2C is a cross sectional view of the present invention with the fixed inner lining.
Figure 3:
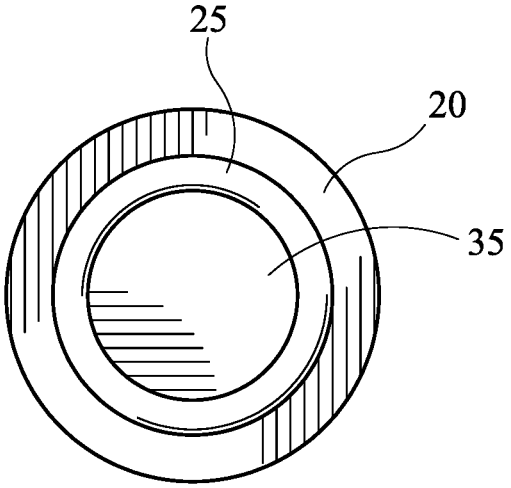
FIG. 3 is a top view of the present invention.

FIGS. 2A, 2B, and 2C are cross sectional views of the sea salt cup 5, more clearly illustrating its hollow interior 15, its rim 20, and its salty lip 30, as well as its inner lining 35 which has a lip or slight overhang 25. In one embodiment of the invention as shown in FIGS. 1A, 1B, and 2C, the sea salt cup 5 has a fixed inner lining 35 comprised of plastic or other durable material not susceptible to erosion or degradation when filled with liquids such as alcoholic beverages or other food items such as soups or stews. The fixed inner lining 35 is fashioned to fit snugly and seamlessly inside the hollow interior of the sea salt cup 15 and may vary in height depending on the dimension of the sea salt cup and the desired height of the salty lip 30. The positioning and seamless fit of the inner lining 35 creates a barrier between any liquid or food item poured into the sea salt cup 5 and the salt, preventing the salt from drastically altering or overpowering the taste and consistency of the food item. This barrier serves to prevent or significantly minimize the intermixing of the salt and liquid or food item while the salty lip 30 serves to enhance the flavor of the liquid or food item as it is being tasted a user. Upon sipping or tasting the food item contained inside of the sea salt cup 5, the user's mouth first comes into contact with salty lip 30, followed immediately by the liquid or food item, and thus the user is able to experience the flavor of the salt mixed with the liquid or food item. A drinker may choose to use the salty lip 30 before, during, and/or after drinking the liquid or eating the food contents of the sea salt cup 5. FIG. 3 is a top view of the invention 5 with the fixed inner lining 35.

Figure 4:
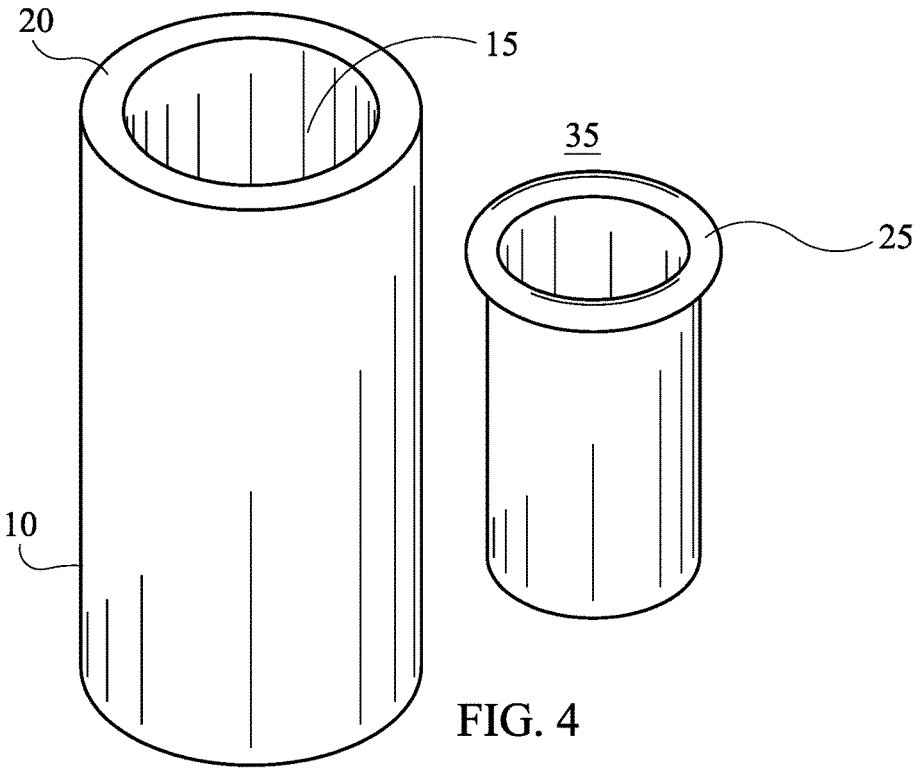
FIG. 4 is a perspective view of the invention illustrating the salty lip and removable inner lining.
Figure 5:
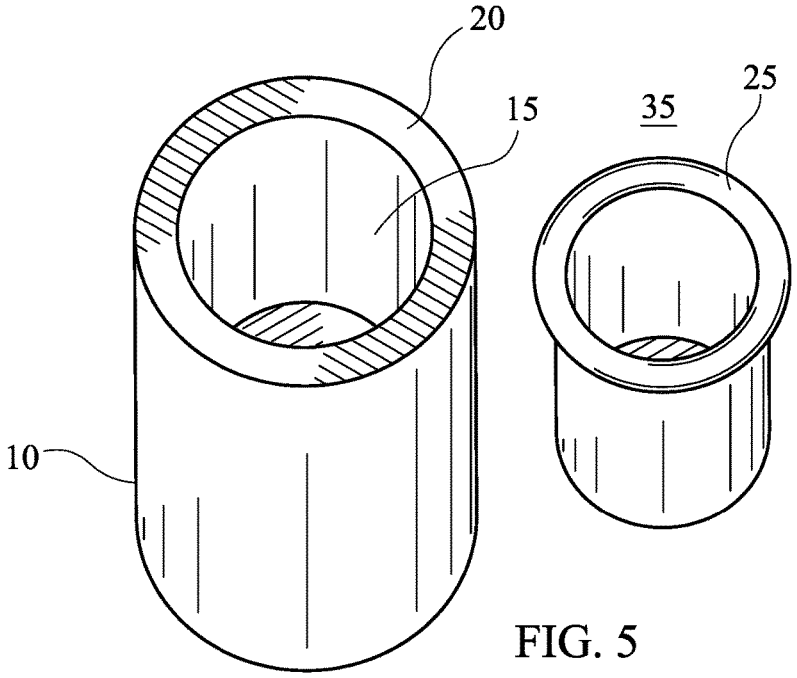
FIG. 5 is a top view of the invention illustrating the removable inner lining and salty lip.

FIG. 4 is a perspective view of another embodiment of the present invention wherein the inner lining 35 is removable and FIG. 5 is a top perspective view of same. The removable inner lining 35 may be made of plastic or other durable material not susceptible to erosion or degradation by the addition of liquids, in particular alcoholic beverages. The removable inner lining 35 has a lip or slight overhang 25 and is fashioned to snugly and seamlessly fit the dimensions of the sea salt cup 5, having a height that varies depending on the dimensions of the sea salt cup 5 and/or the desired height of the salty lip 30. The ability to insert or remove the inner lining 35 provides a user with options and flexibility in experiencing and enjoying a salt flavored drink or food item. For example, a drinker of a margarita styled shot may desire more salt for heightened flavor and choose to use the sea salt cup without the inner lining 35, placing the liquid directly inside of the interior salt receptacle 15 (as shown in FIGS. 4 and 5). Whereas another drinker may desire to have one quick shot of tequila without the inner lining 35 (as shown in FIGS. 4 and 5), then follow up with a second shot desiring less salt flavor whereby choosing to insert the inner lining 35 and utilize the salty lip 30 before, during, or after the second shot.

Figure 6A:
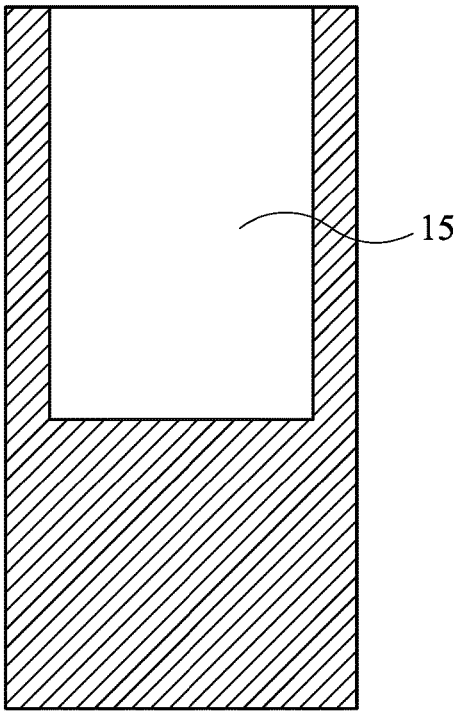
FIG. 6A is a cross sectional front view of the invention without the inner lining.
Figure 6B:
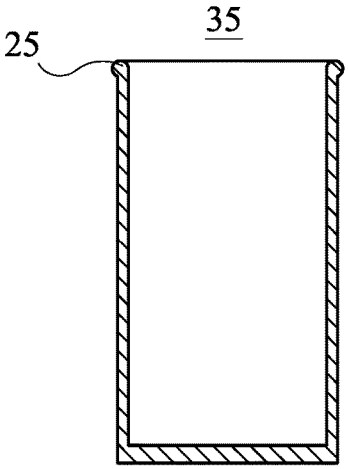
FIG. 6B is a cross sectional front view of the removable inner lining.
Figure 6C:
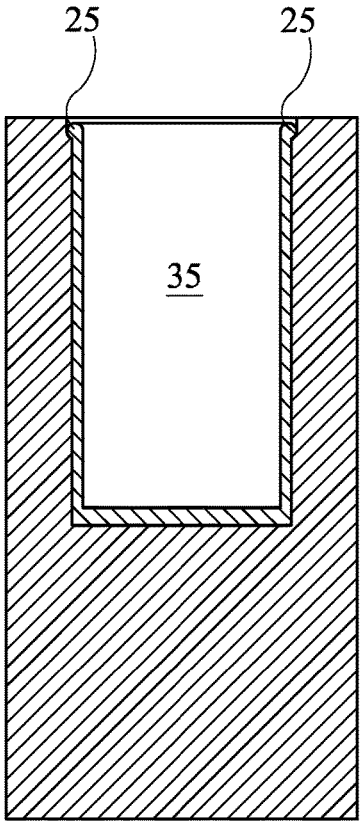
FIG. 6C is a cross sectional front view of the invention with the removable inner lining inserted.
Figure 7:
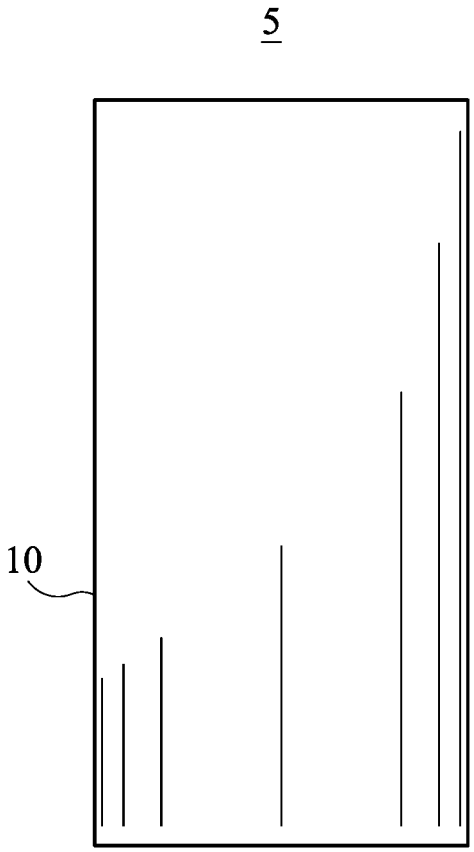
FIG. 7 is a front view of the present invention.
Figure 8:
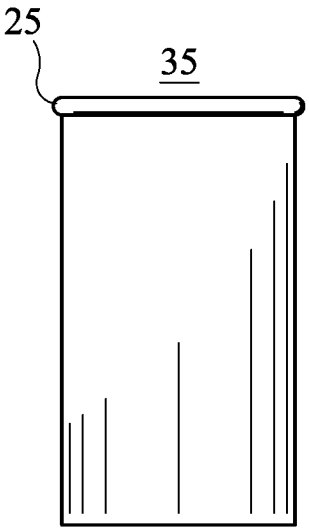
FIG. 8 is a front view of the removable inner lining.

FIGS. 6A, 6B, and 6C are cross sectional front views of the invention, illustrating the basic outer dimensions of the sea salt cup 5. FIG. 6A shows a cross section of the interior salt receptacle 15; FIG. 6B shows a cross sectional front view of the inner lining 35 which has a lip 25; and FIG. 6C shows a cross sectional front view of the inner lining 35 inserted into the sea salt cup 5, illustrating the positioning of the inner lining 35 in relation to the rim 20 of the sea salt cup 5. FIGS. 6A, 6B, and 6C are not meant to be limiting as the embodiments of the sea salt cup 5 and its components described herein may vary in size, dimension, shape and ornamentation. FIG. 7 is a front view of the sea salt cup 5 and FIG. 8 is a front view of the inner lining 35 with a lip 25. The exterior 10 of the sea salt cup 5 described herein may have a polished finish or retain its original coarseness; it may be engraved, painted, tattooed or otherwise decorated to change its ornamentation and natural coloring. The unrefined sea salt used to form a cup or receptacle may originate from various regions, including but not limited to the mountains of Pakistan or the nearby Himalayan regions.

The lip or slight overhang 25 of the inner lining 35 as shown in FIG. 8 is pronounced in appearance for illustrative purposes. However, the lip or slight overhang 25 of the inner lining 35 is about 0.01 mm or less and is positioned flushed against the interior of the uniformly sized interior 15 of the sea salt cup 5. By its positioning, the lip 25 of the inner lining 35 creates a barrier between any liquid or food item contained inside the sea salt cup 5 and the salty lip 30. The size of the lip 15 of the inner lining 35 may vary depending on the dimensions of the sea salt cup 5.

As various changes may be made in the above-described subject matter without departing from the scope and the spirit of the invention, it is intended that all subject matter contained in the above description, or shown in the accompanying drawings, will be interpreted as descriptive and illustrative, and not in a limiting sense. Many modifications and variations of the present invention are possible in light of the above teachings. It is therefore to be understood that within the scope of the appended claims, the invention may be practiced otherwise than as specifically described.

EQUIVALENTS

Those skilled in the art will recognize, or be able to ascertain using no more than routine experimentation, many equivalents to the specific embodiments of the invention described herein. Such equivalents are intended to be encompassed by the claims.

What is claimed is:

1. A sea salt cup comprising:

a cylindrical receptacle formed entirely from a single block of unrefined sea salt; having a uniform exterior portion, a uniform hollow interior portion having a length, a flat bottom portion, a flat top rim portion and a salty lip;

a fixed inner lining made of plastic and fashioned to seamlessly fit the dimensions of the hollow interior portion, which inner lining has a 0.1 mm lip that creates a seamless barrier between the salt and any liquid or food item held inside of the sea salt cup, and which seamless barrier fits flush against the length of the hollow interior portion of the cylindrical receptacle; and the salty lip extending from a top of the lip of the inner lining and upwards to define a portion of the hollow interior portion and ending at the flat tip rim of the cylindrical receptacle.

2. The sea salt cup in claim 1 wherein the inner lining is made of a durable material that is not easily degradable by the sea salt or any liquid or food item contained therein.

3. The sea salt cup in claim 1 wherein the exterior portion is engraved, painted, tattooed or otherwise decorated.

4. A sea salt cup comprising:

a cylindrical receptacle formed entirely from a single block of unrefined sea salt; having a uniform exterior portion, a uniform hollow interior portion having a length, a flat bottom portion, a flat top rim portion and a salty lip;

a removable inner lining made of plastic and fashioned to seamlessly fit the dimensions of the hollow interior portion, which removable inner lining has a 0.1 mm lip that creates a seamless barrier between the salt and any liquid or food item held inside of the sea salt cup, and which seamless barrier fits flush against the length of the hollow interior portion of the cylindrical receptacle; and the salty lip extending from a top of the lip of the removable inner lining and upwards to define a portion of the hollow interior portion and ending at the flat top rim of the cylindrical receptacle.

5. The sea salt cup in claim 4 wherein the removable inner lining is made of a durable material that is not degradable by the sea salt or the liquid contained therein.

6. The sea salt cup in claim 4 wherein the exterior portion is engraved, painted, tattooed or otherwise decorated.

* * * * *